US012144388B2

(12) United States Patent
Hautala

(10) Patent No.: US 12,144,388 B2
(45) Date of Patent: Nov. 19, 2024

(54) ADJUSTABLE FIT GLOVE, KIT, AND METHODS THEREFOR

(71) Applicant: Matthew D. Hautala, Grand Junction, CO (US)

(72) Inventor: Matthew D. Hautala, Grand Junction, CO (US)

( * ) Notice: Subject to any disclaimer, the term of this patent is extended or adjusted under 35 U.S.C. 154(b) by 185 days.

(21) Appl. No.: 17/519,518

(22) Filed: Nov. 4, 2021

(65) Prior Publication Data

US 2023/0134336 A1 May 4, 2023

(51) Int. Cl.
*A41D 19/00* (2006.01)

(52) U.S. Cl.
CPC ..... *A41D 19/0058* (2013.01); *A41D 2400/44* (2013.01); *A41D 2500/50* (2013.01)

(58) Field of Classification Search
CPC . A41D 19/0058; A41D 19/04; A41D 19/0062
See application file for complete search history.

(56) References Cited

U.S. PATENT DOCUMENTS 3,329,143 A * 7/1967 Gordon ..... A61F 15/004 D24/190
5,734,992 A * 4/1998 Ross ..... A41D 13/08 2/161.7
2003/0023196 A1* 1/2003 Liguori ..... A61F 13/105 602/41
2010/0256542 A1* 10/2010 Nausid ..... A61F 13/041 602/3
2015/0157070 A1* 6/2015 Baacke ..... A41D 19/02 2/167
2019/0239585 A1* 8/2019 Chou ..... A41D 19/0006

FOREIGN PATENT DOCUMENTS

CA 2379185 A1 * 1/2001
WO WO-2022225979 A1 * 10/2022

* cited by examiner

*Primary Examiner* — Tajash D Patel

(57) ABSTRACT

An adjustable fit glove that utilizes a heat shrinkable material.

18 Claims, 5 Drawing Sheets

ADJUSTABLE FIT GLOVE, KIT, AND METHODS THEREFOR

BACKGROUND

Reusable and disposable gloves have long been used in many industries as a safe and cost effective way to protect an individual from a product, a product from an individual, or simply to keep an individual's hands clean. Several types of disposable gloves are readily available in the marketplace and are used to provide added protection for such individuals, such as rubber, latex, vinyl, nitrile, plastic, and/or polyethylene. Reusable and disposable gloves are utilized in several different industries and by individual consumers for home use. A variety of sizes are offered for disposable and reusable gloves to try to meet the needs of different users.

SUMMARY

The techniques of this disclosure generally relate to a glove that can be adjusted to fit various different hand sizes and/or shapes.

In one aspect, the present disclosure provides an adjustable fit glove. The adjustable fit glove includes a heat activated shrink material that is shaped in the form of a glove. The heat activated shrink material shrinks upon the application of heat at 180 degrees Fahrenheit or higher.

In another aspect, the present disclosure provides an adjustable fit glove. The adjustable fit glove includes a heat activated shrink material. The heat activated shrink material is shaped in the form of a glove. The heat activated shrink material is made of polyolefin with one or more elofin varieties and has a shrink ratio of at least 1.5:1. The heat activated shrink material has a longitudinal shrinkage of +1/−5%. The heat activated shrink material shrinks upon the application of heat at 190 degrees Fahrenheit or higher and has an operating temperature range after shrinkage of −55 degrees Celsius to 175 degrees Celsius.

In another aspect, the disclosure provides a kit for an adjustable fit glove. The kit includes a glove and instructions. The glove is made of a heat activated shrink material. The heat activated shrink material comprises a polyolefin and has a shrink ratio of at least 1.5:1. The instructions instruct a user to place the glove over a hand. Once placed, the instruction instruct the use to apply a heat of at 180 degrees Fahrenheit or higher using a specific medium to the glove.

In a further aspect, the disclosure provides a method for making an adjustable fit glove. The method includes:

- selecting a synthetic material;
- cross-linking the synthetic material;
- dipping a hand shaped former in the cross-linked synthetic material;
- heating the cross-linked synthetic material on the hand shaped former to create a glove; and
- stretching the glove to at least 1.5 times the starting size.

The details of one or more aspects of the disclosure are set forth in the accompanying drawings and the description below. Other features, objects, and advantages of the techniques described in this disclosure will be apparent from the description and drawings, and from the claims.

DETAILED DESCRIPTION

As discussed above, reusable and disposable gloves made out of rubber, latex, plastic, etc. have been utilized by many for several different purposes. However, the gloves are made in predetermined sizes. The predetermined sizes may not be a great fit for each and every user since hand size and/or shape may vary significantly between users. This misalignment in fit can make it hard to get a glove on or off and can affect a user's dexterity while wearing the glove. As such, there is a need for a glove that can be adjusted to fit the various hand sizes and/or shapes of its users.

Figure 1:
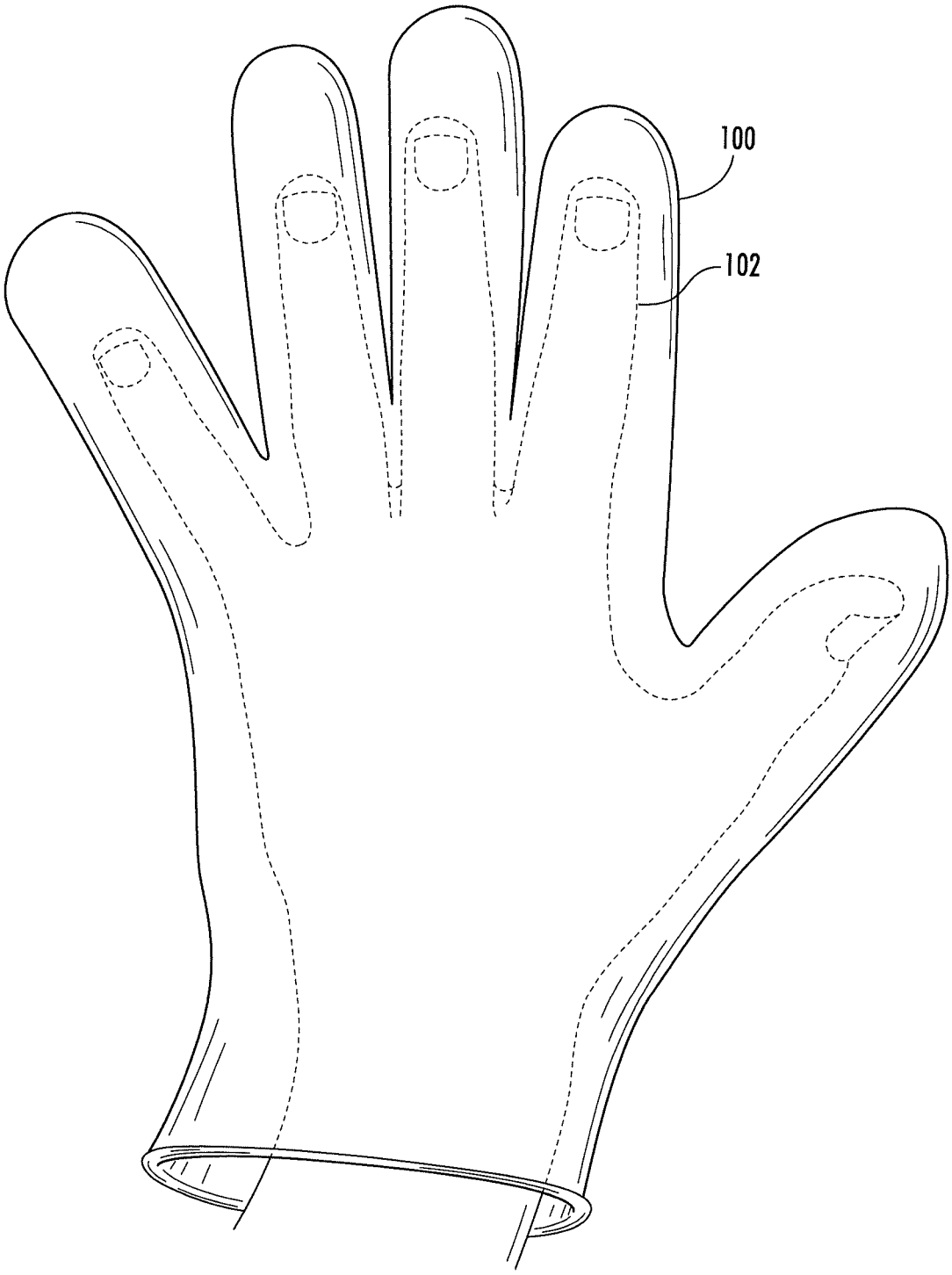
FIG. 1 is a top view that illustrates one configuration of an adjustable fit glove placed over a user's hand prior to the application of heat.
Figure 2:
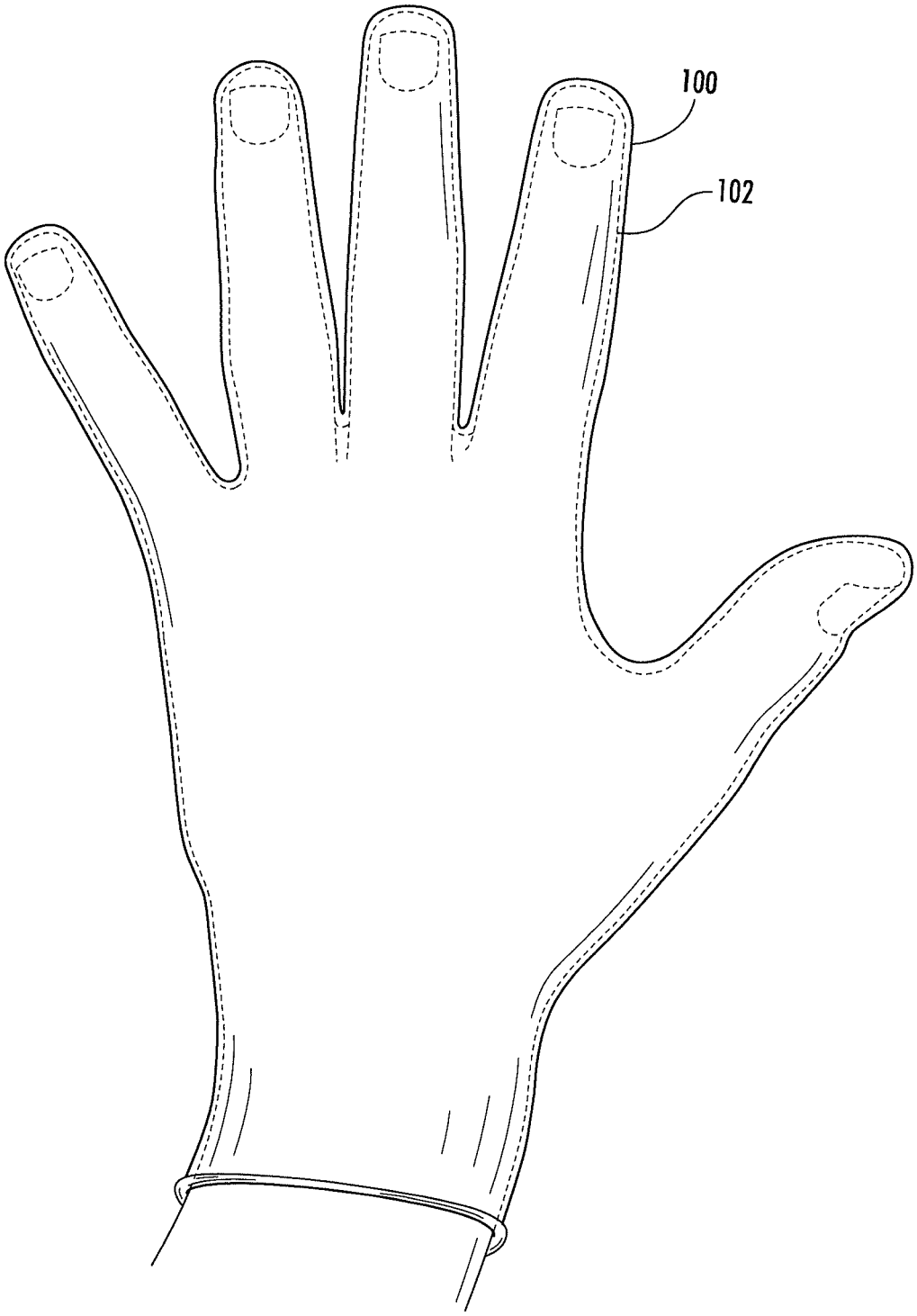
FIG. 2 is a top view that illustrates one configuration of an adjustable fit glove placed over a user's hand after the application of heat.

FIGS. 1 and 2 illustrate different configurations of an adjustable fit glove 100. FIG. 1 illustrates a configuration of an adjustable fit glove 100 on a hand 102 of a user prior to the application of heat or prior to adjusting the fit of the glove 100. The glove 100 may be disposable after a single use or multiple uses. Alternatively, the glove 100 may be reusable or designed for multiple uses. The glove 100 may include any type of hand covering, such as mittens or other configurations with or without one or more separate parts for one or more fingers and/or the thumb.

The glove 100 has an adjustable fit because the glove 100 is made of a heat shrinkable material. In some embodiments, the heat shrinkable material is made of one or more polymers. The one or more polymers may include polyolefin. In some aspects, the polyolefin includes one or more elofin varieties. The heat shrinkable material shrinks in response to the application of heat at 180 degrees Fahrenheit or more. In some aspects, the heat shrinkable material shrinks in response to the application of heat at 190 degrees Fahrenheit or more. In other aspects, the heat shrinkable material shrinks in response to the application of heat at 200 degrees Fahrenheit or more. This list is exemplary and is not meant to be limiting. Any suitable application of heat for shrinking a material as would be known by a person of skill in the art may be utilized to adjust the fit of the glove 100.

FIG. 2 illustrates a configuration of an adjustable fit glove 100 on a hand 102 of a user after the application of heat or after adjusting the fit of the glove 100. The user may apply the required heat until the glove 100 shrinks to a desired fit of the user and/or until maximum heat application time frame is met. In some aspects, the glove 100 has an operating temperature range after shrinkage of −55 degrees Celsius to 175 degrees Celsius. In other aspects, the heat shrink material has a shrink ratio of 1.5:1, 2:1, or 2.5:1 or other ratios similar to, around, and/or between the provided ratios. In some aspects, the heat activated shrink material has a longitudinal shrinkage of +1/−5% or about +1/−5%. The provided shrink ratios are exemplary and are not meant to be limiting. Any appropriate shrink ratio may be utilized as would be understood by a person of skill in the art.

Given that the heat shrink material has a specific shrink ratio and will only be able to shrink so much, in some aspects, the glove 100 may be formed in different sizes to account for the variation in hand size and/or shape of the users. Currently utilized disposable gloves that are not adjustable in fit are often found the following sizes: extra-small (up to 2.9 inches), small (2.9-3.3 inches), medium (3.2-3.5 inches), large (3.5-4 inches), extra-large (3.9-4.4 inches), and/or double extra-large (4.4 inches and larger). The distance measurements above represent palm length measured along the head line between the base of the finger and base of the thumb. In some aspects, the adjustable fit glove 100 could be adjusted, upon the application of heat, to fit a hand sized from double extra-large (4.4 inches and over) to small (2.9-3.3 inches) based on the glove sizes above. For example, the glove 100 may have a palm length of 6 inches and be able to shrink to 3 inches upon the application heat, which is 2:1 minimum shrink ratio. In some aspects, the adjustable fit glove 100 could be adjusted, upon the application of heat, to fit a hand sized from double extra-large (4.4 inches and over) to extra small (up to 2.9 inches) based on the glove sizes above. For example, the glove 100 may have a palm length of 5 inches and be able to shrink to 2.5 inches upon the application heat, which is 2:1 minimum shrink ratio. These sizes and shrink ratios are merely exemplary and are not meant to be limiting. The size and shrink ratio of the adjustable fit glove 100 may vary as desired as would be understood by a person of skill in the art. While the glove 100 may be formed in different sizes to account for the variation in hand size and/or shape of the users, as shown by the examples above, the glove 100 could be provided in one-size fits all. In other aspects, the glove 100 may be provided in just a few different sizes, such as youth and adult, to account for variation in hand sizes and/or shapes unlike previously utilized gloves that did not adjust in size and required multiple sizes to account for variation in hand sizes and/or shapes.

In some aspects, the heat activated shrink material may have a thickness of 6 gauge or higher. In other aspects, the heat activated shrink material has a thickness of 5 millimeters, 6 millimeters, or 7 millimeters or higher. In additional aspects, the heat activated shrink material has a thickness of 8 millimeters, 9 millimeters, or higher.

Figure 3:
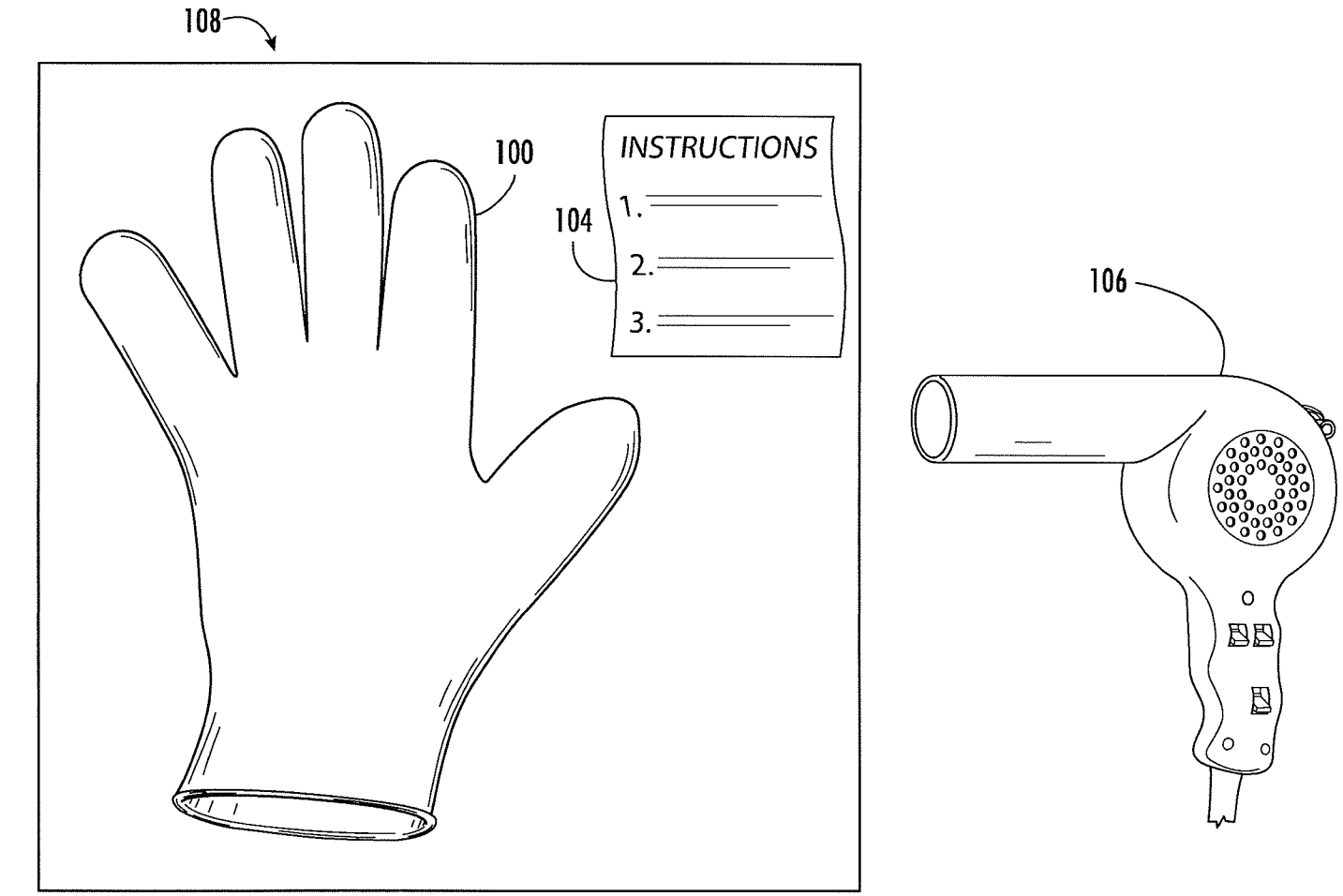
FIG. 3 is a top view that illustrates one configuration of a kit for an adjustable fit glove.

FIG. 3 illustrates one configuration of a kit 108 for an adjustable fit glove 100. The kit 108 includes a glove 100 made of a heat activated shrink material and a set of instructions 104. The instructions 104 indicate a medium for applying heat to the glove 100. In some aspects, the instructions 104 provide a time frame for applying the required amount of heat and/or a distance for heat application. In some aspects, the time frame is a maximum amount time a user should apply heat to the glove 100. In further aspects, the instructions 104 instruct the user to dispose of the adjustable fit glove 100 after a single use. In other aspects, the instructions 104 instruct the user to dispose of the adjustable fit glove 100 after a predetermined number of uses. In alternative embodiments, the glove 100 provided in the kit 108 is reusable. In some aspects, the instructions 104 may indicate that heat should be applied to the glove 100 until a desired fit is obtained by the user and/or a maximum time limit is reached. In some aspects, the instructions 104 may instruct the user to place the glove 100 on his or her hand 102 prior to the application of heat.

The medium provides heat at 180 degrees Fahrenheit or higher, which may be required by the instructions 104. In other aspects, the medium provides heat at 190 degrees Fahrenheit or higher, which may be required by the instructions 104. In further aspects, the medium provides heat at 200 degrees Fahrenheit or higher, which may be required by the instructions 104. In some embodiments, the instructions 104 instruct the user to use a hair dryer 106 as the medium for applying heat to the glove 100. Other mediums may be utilized or provided in the instructions 104 as would be known by a person of skill in the art. In alternative embodiments, the kit 108 includes a medium for applying heat. In some aspects, the medium provided in the kit 108 is a hair dryer 106. While the hair dryer 106 is not part of the kit 108 illustrated in FIG. 3, FIG. 3 is just one example embodiment and the hair dryer 106 may be included in the kit 108 in another embodiment.

Figure 4:
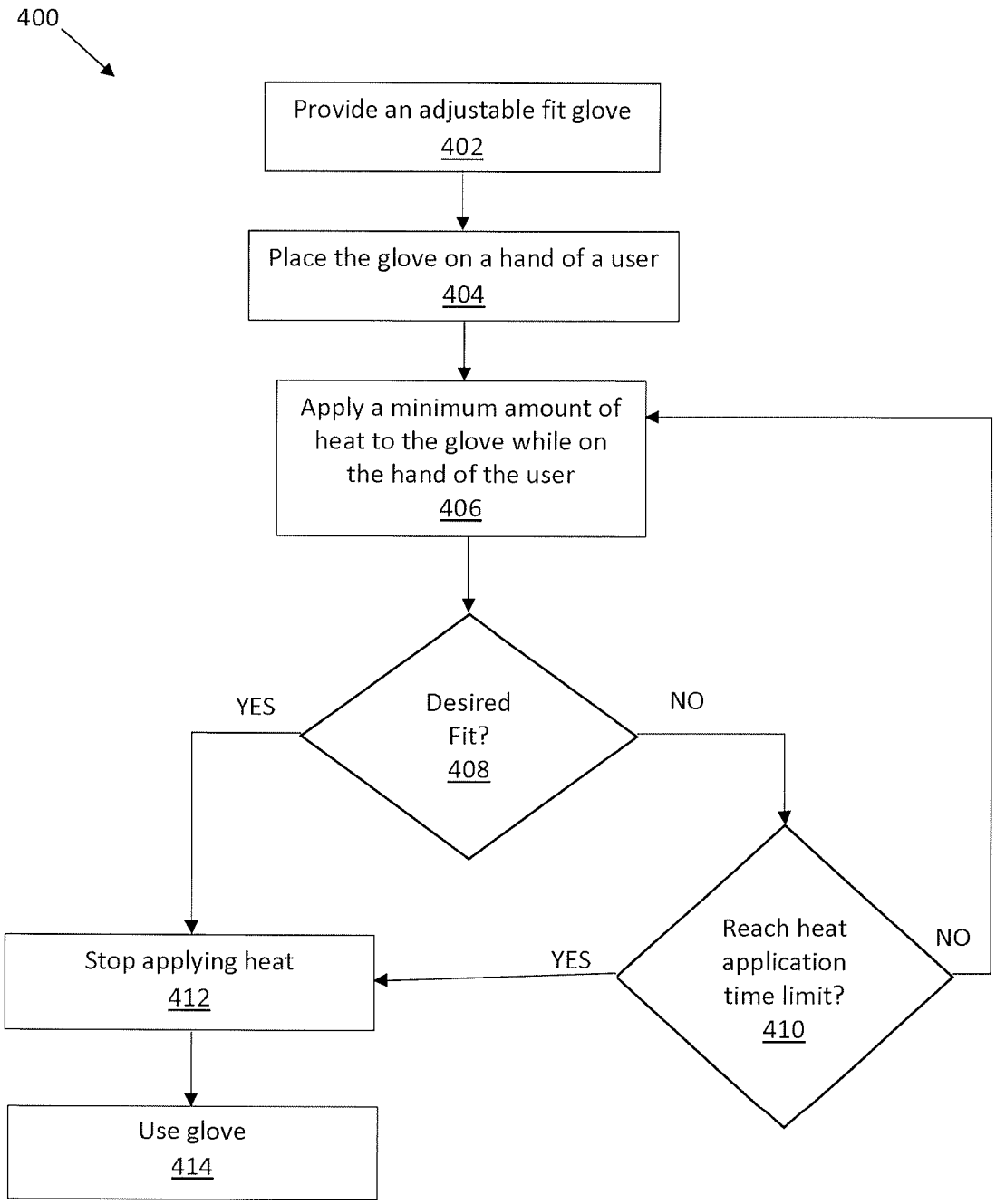
FIG. 4 is a flow chart that illustrates one configuration of a method for using an adjustable fit glove.

FIG. 4 is a flow chart that illustrates an example of a method 400 for using an adjustable fit glove 100. Method 400 begins at block 402 by providing an adjustable fit glove 100. Next, at block 404, the glove 100 is placed on the hand 102 of the user. At block 406, a minimum amount of heat is applied to the glove 100 while on the hand 102 of the user. Block 408 is a decision step, where the user determines if the glove 100 has reached a user desired fit. If a desired fit is reached, method 400 proceeds to block 412. If a user desired fit has not been reached, method 400 proceeds to decision block 410. Block 408 is a decision step where the user determines if the maximum amount of time for the application of heat has been reached. If the maximum amount of time for the application has not been reached, then method 400 proceeds back to block 406. If the maximum amount of time for the application has been reached, then method 400 proceeds to block 412. At block 412, the heat application is stopped. Next, at block 414, the glove 100, which has shrunk in size, is ready for use by the user.

Figure 5:
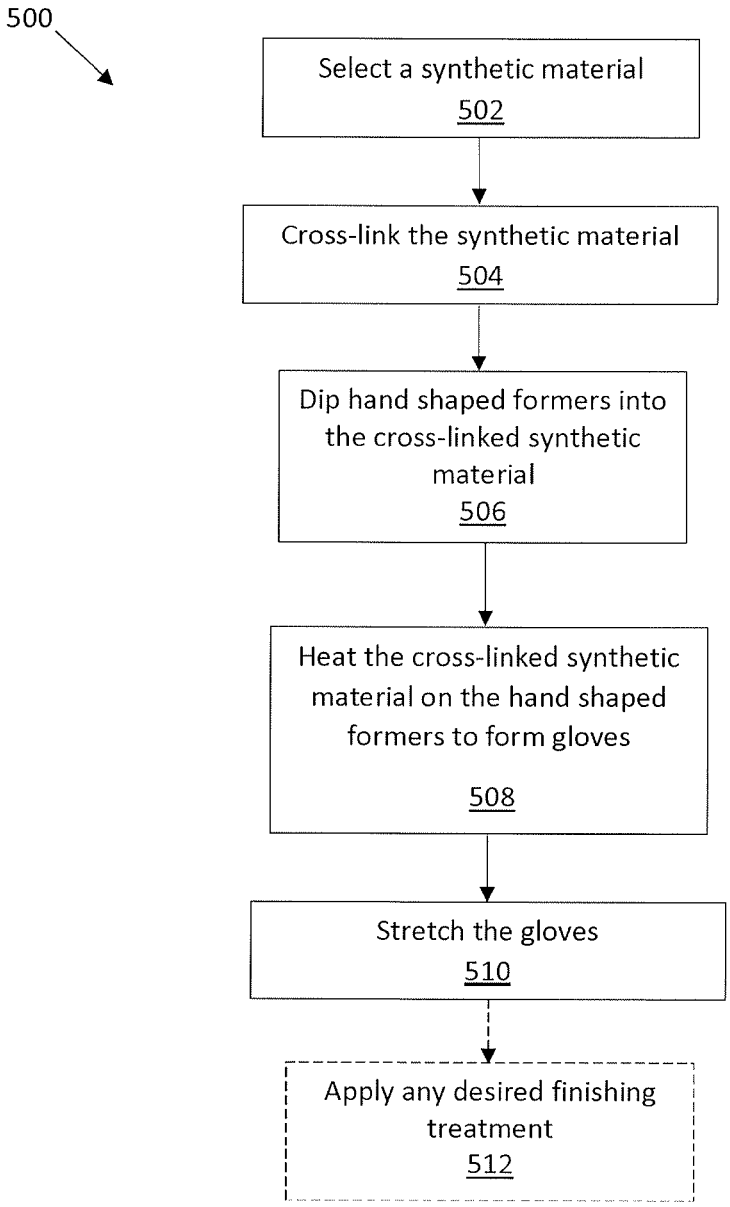
FIG. 5 is a flow chart that illustrates one configuration of method for forming an adjustable fit glove.

FIG. 5 is a flow chart that illustrates an example of a method 500 for making an adjustable fit glove 100. Method 500 begins at block 502 where a synthetic material is selected. In some aspects the synthetic material is for a nitril glove. For example, the synthetic material may be nitrile butadiene rubber (NBR). In other aspects, the synthetic material is for a vinyl glove. For example, the synthetic material may be a polymer, such as polyvinyl chloride (PVC). In some aspects, plasticizer is added to the PVC to make the material more flexible.

Next, at block 504, the synthetic material is crossed-linked to form a cross-linked synthetic material. The cross-linking may be accomplished in different ways, such as: heat, the addition of chemical cross-linking compounds, and/or a change in pressure or pH. In other aspects, radiation can also be used to form cross-links. Cross-linking the synthetic material with radiation changes the thermal properties of the material and induces a memory in the material.

At block 506, one or more hand shaped formers are dipped into the cross-linked synthetic material. In some aspects, the hand shaped formers are made of ceramic. In other aspects, at block 506, the hand shaped formers are run through water and/or bleach and then dried to clean the hand-shaped formers prior to being dipped into the cross-linked synthetic material. In further aspects, at block 506, the hand shaped formers are dipped in a mixture of calcium carbonate and calcium nitrate and then dried. This mixture may help the cross-linked synthetic material coagulate around the formers. In some embodiments, the hand shaped formers have a palm length of 5 inches. In other aspects, the hand shaped formers have a palm length of 4 inches. In further aspects, the hand shaped formers have a palm length of 3 inches. The palm lengths provided above are exemplary only and are not meant to be limiting. The palm lengths of the hand shaped formers may vary as desired as would be know by a person of skill in the art.

Next, at block 508, the cross-linked synthetic material on the one or more hand shaped formers is heated to form one or more gloves. In further aspects, the gloves are dried once formed at block 508. The temperature applied will vary depending upon the cross-linked synthetic material and/or the thickness of the cross-linked synthetic material as would be known by a person of skill in the art.

At block 510, the one or more gloves are stretched to provide for an adjustable fit. In some aspects, the gloves are stretched to two times the starting size. In other aspects, the gloves are stretched to 1.5 times the starting size. In additional, aspects the glove may be stretched to 2.5 times the starting size. This list is exemplary and is not meant to be limiting. The gloves may be stretched as suitable for the material as would be know by a person skill in the art.

In some embodiment, method 500 also includes block 512. At block 512 any desired finishing treatments may be applied to the glove. In some aspects, block 512 is performed after block 510. In other aspects, block 512 is performed before block 510. For example, at block 510, to help nitrile gloves go on more easily, these types of gloves may undergo one of two processes: chlorination or polymer coating. Chlorination involves exposing the gloves to chlorine. The chlorine may be an acid mixture or gas. The chlorine hardens the material and makes the material slicker. In other embodiments, at block 512, a polymer coating is applied to the glove to lubricate the glove surface by adding a layer of polymer. In further aspects, at block 512, blasts of air are applied to the one or more gloves to remove the one or more gloves from the former.

It should be understood that various aspects disclosed herein may be combined in different combinations than the combinations specifically presented in the description and accompanying drawings. It should also be understood that, depending on the example, certain acts or events of any of the processes or methods described herein may be performed in a different sequence, may be added, merged, or left out altogether (e.g., all described acts or events may not be necessary to carry out the techniques). In addition, while certain aspects of this disclosure are described as being performed by a single module or unit for purposes of clarity, it should be understood that the techniques of this disclosure may be performed by a combination of units or modules associated with, for example, a medical device.

What is claimed is:

1. An adjustable fit glove, comprising:

a heat activated shrink material shaped in the form of a glove, wherein the heat activated shrink material shrinks upon application of heat at 190 degrees Fahrenheit or higher.

2. The adjustable fit glove of claim 1, wherein the adjustable fit glove is disposable.

3. The adjustable fit glove of claim 1, wherein the heat activated shrink material comprises a polyolefin.

4. The adjustable fit glove of claim 3, wherein the polyolefin includes one or more elofin varieties.

5. The adjustable fit glove of claim 4, wherein the heat activated shrink material further comprises one or more polymers.

6. The adjustable fit glove of claim 2, wherein the heat activated shrink material has an operating temperature range after shrinkage of −55 degrees Celsius to 175 degrees Celsius.

7. The adjustable fit glove of claim 2, wherein the heat activated shrink material has a shrink ratio of 2:1.

8. The adjustable fit glove of claim 2, wherein the heat activated shrink material has a longitudinal shrinkage of +1/−5%.

9. The adjustable fit glove of claim 1, wherein the heat activated shrink material has a thickness of 6 gauge or higher.

10. The adjustable fit glove of claim 1, wherein the heat activated shrink material has a thickness of 5 millimeters or 9 millimeters or higher.

11. An adjustable fit glove comprising:

a heat activated shrink material shaped in the form of a glove, wherein the heat activated shrink material comprises polyolefin with one or more elofin varieties, wherein the heat activated shrink material has a shrink ratio of at least 1.5:1, wherein the heat activated shrink material has a longitudinal shrinkage of +1/−5%, and wherein the heat activated shrink material shrinks upon application of heat at 190 degrees Fahrenheit or higher and has an operating temperature range after shrinkage of −55 degrees Celsius to 175 degrees Celsius.

12. The adjustable fit glove of claim 11, wherein the adjustable fit glove is disposable after a single use.

13. The adjustable fit glove of claim 11, wherein the heat activated shrink material has a thickness of 6 gauge or higher.

14. The adjustable fit glove of claim 11, wherein the heat activated shrink material has a thickness of 5 millimeters or 9 millimeters or higher.

15. A kit for an adjustable fit, glove, comprising:

a glove made of a heat activated shrink material, wherein the heat activated shrink material comprises a polyolefin and has a shrink ratio of at least 1.5:1; and instructions, wherein the instructions instruct a user to:

place the glove over a hand; and apply a heat of 190 degrees Fahrenheit or higher using a specific medium to the glove while the glove is placed on the hand.

16. The kit for the adjustable fit of claim 15, wherein the instructions instruct the user to dispose of the adjustable fit glove after a single use.

17. The kit for the adjustable fit glove of claim 15, further comprising:

a medium, wherein the medium is a hair dryer.

18. The kit for the adjustable fit glove of claim 15, wherein the heat activated shrink material has a longitudinal shrinkage of +1/−5%.

* * * * *